US007883186B2

(12) United States Patent
Enomoto et al.

(10) Patent No.: US 7,883,186 B2
(45) Date of Patent: Feb. 8, 2011

(54) LIQUID EJECTION HEAD, METHOD OF MANUFACTURING LIQUID EJECTION HEAD AND IMAGE FORMING APPARATUS

(75) Inventors: Katsumi Enomoto, Kanagawa-ken (JP); Yasuhiko Maeda, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 657 days.

(21) Appl. No.: 11/898,166

(22) Filed: Sep. 10, 2007

(65) Prior Publication Data

US 2008/0062223 A1 Mar. 13, 2008

(30) Foreign Application Priority Data

Sep. 11, 2006 (JP) ..... 2006-245861

(51) Int. Cl.
*B41J 2/45* (2006.01)

(52) U.S. Cl. ..... 347/68; 347/71

(58) Field of Classification Search ..... 347/40, 347/43, 67–72

See application file for complete search history.

(56) References Cited

U.S. PATENT DOCUMENTS 6,942,316 B2 * 9/2005 Scheffelin et al. ..... 347/42

7,090,323 B2 * 8/2006 Takatsuka ..... 347/17

FOREIGN PATENT DOCUMENTS

JP 6-23988 A 2/1994

JP 2002-144576 A 5/2002

* cited by examiner

*Primary Examiner*—Lamson D Nguyen

(74) *Attorney, Agent, or Firm*—Birch, Stewart, Kolasch & Birch, LLP

(57) ABSTRACT

The liquid ejection head has: a plurality of head units each of which includes a plurality of nozzles, a plurality of pressure chambers connected respectively to the plurality of nozzles, liquid supply ports for supplying liquid respectively to the plurality of pressure chambers, and a plurality of actuators causing the liquid to be ejected respectively from the plurality of nozzles; and a single common liquid chamber plate formed with a common liquid chamber which supplies the liquid to the plurality of pressure chambers of the plurality of head units, wherein: the plurality of head units are arranged in a planar configuration; the plurality of head units are covered with the single common liquid chamber plate; and the common liquid chamber is provided in common to the plurality of head units.

8 Claims, 12 Drawing Sheets

LIQUID EJECTION HEAD, METHOD OF MANUFACTURING LIQUID EJECTION HEAD AND IMAGE FORMING APPARATUS

BACKGROUND OF THE INVENTION

1. Field of the Invention

The present invention relates to a liquid ejection head having good ejection characteristics and to a method of manufacturing such a liquid ejection head at low cost.

2. Description of the Related Art

It is known that one liquid ejection head can be constituted by aligning a plurality of head units, each formed with a plurality of nozzles (ejection ports), a plurality of pressure chambers connected respectively to the plurality of nozzles, and a plurality of actuators which eject liquid respectively from the plurality of nozzles by respectively changing the pressure inside the plurality of pressure chambers, together with a single common liquid chamber which supplies liquid to the plurality of pressure chambers.

Moreover, Japanese Patent Application Publication No. 2002-144576 discloses a liquid ejection head comprising an element substrate provided with a plurality of ejection ports and ejection energy generating elements, and a common liquid chamber.

Furthermore, Japanese Patent Application Publication No. 6-23988 discloses an apparatus comprising nozzles, pressure chambers which fill with ink, a pressurization device which applies pressure to the ink in the pressure chambers, and an ink storing unit which stores ink to be supplied to the pressure chambers, wherein the pressure chambers and the ink storing unit are mutually separated by means of a porous member.

There are demands for a full line type of liquid ejection head which achieves good ejection characteristics at low cost.

A full line type of liquid ejection head has a structure in which a plurality of nozzles are formed through a length corresponding to the full width of the ejection receiving region, and although such a head is capable of high-speed processing, it may involve possibilities such as high costs, ejection variations between the nozzles, and the like.

Furthermore, if it is sought to compose a long, bar-shaped liquid ejection head by means of a plurality of short head units, then there is also a possibility that the liquid in the common liquid chamber is liable to leak out between the head units.

In the head described in Japanese Patent Application Publication No. 2002-144576, a long bar-shaped liquid ejection head is composed by means of a plurality of short head units (element substrates), and therefore it is necessary to seal the gaps between the head units in such a manner that the liquid inside the common liquid chamber does not leak out from the gaps between the head units, but if it is sought to seal these gaps between the head units by means of a sealing material, then large areas where nozzles cannot be disposed are created in the gaps between the head units.

In the technology described in Japanese Patent Application Publication No. 6-23988, a porous member is provided between the ink accommodating unit and the pressure chambers, and therefore if it is sought to compose a long bar-shaped liquid ejection head by means of a plurality of short head units, the liquid passing through the porous member will leak out from the gaps between the head units.

SUMMARY OF THE INVENTION

The present invention has been contrived in view of the aforementioned circumstances, an object thereof being to provide a liquid ejection head having good ejection characteristics at low cost and a method of manufacturing such a liquid ejection head.

In order to attain the aforementioned object, the present invention is directed to a liquid ejection head comprising: a plurality of head units each of which includes a plurality of nozzles, a plurality of pressure chambers connected respectively to the plurality of nozzles, liquid supply ports for supplying liquid respectively to the plurality of pressure chambers, and a plurality of actuators causing the liquid to be ejected respectively from the plurality of nozzles; and a single common liquid chamber plate formed with a common liquid chamber which supplies the liquid to the plurality of pressure chambers of the plurality of head units, wherein: the plurality of head units are arranged in a planar configuration; the plurality of head units are covered with the single common liquid chamber plate; and the common liquid chamber is provided in common to the plurality of head units.

Preferably, the liquid ejection head further comprises: a porous substrate which has permeable properties and is disposed below the single common liquid chamber plate so as to constitute a lower surface plate of the common liquid chamber; and a photosensitive film which is made of a material having photosensitivity and non-permeable properties, has through holes which correspond to an arrangement pattern of the liquid supply ports of the head units, and is attached to a lower surface of the porous substrate; wherein the plurality of head units are bonded to the porous substrate via the photosensitive film.

Preferably, the porous substrate is made of a same material as a main component of the plurality of head units, or a material having a coefficient of linear expansion between 0.5 times and 2 times a coefficient of linear expansion of the main component of the plurality of head units.

Preferably, the liquid ejection head further comprises a selector circuit which selects at least one actuator to be driven, of the plurality of actuators, wherein: the single common liquid chamber plate has a recessed shape which is open toward the plurality of head units; and the selector circuit is disposed on a surface of the single common liquid chamber plate on a side opposite to an open side of the single common liquid chamber plate.

Preferably, the liquid ejection head further comprises drive wires which are formed on an upper surface of the head units and are connected to the actuators.

In order to attain the aforementioned object, the present invention is also directed to a method of manufacturing a liquid ejection head having a plurality of head units each of which includes a plurality of nozzles, a plurality of pressure chambers connected respectively to the plurality of nozzles, liquid supply ports for supplying liquid respectively to the plurality of pressure chambers, and a plurality of actuators causing the liquid to be ejected respectively from the plurality of nozzles, the method comprising the steps of: attaching a photosensitive film made of a material having photosensitivity and non-permeable properties, to one surface of a porous substrate having permeable properties; forming through holes corresponding to an arrangement pattern of the liquid supply ports of the head units, in the photosensitive film, by means of photolithography; aligning positions of the through holes in the photosensitive film and positions of the liquid supply ports of the plurality of head units and bonding the plurality of head units to the porous substrate via the photosensitive film so as to arrange the plurality of head units in a planar configuration; and bonding a single common liquid chamber plate formed with a common liquid chamber which is common to the plurality of head units, to a surface of the porous substrate on an opposite side to a surface of the porous substrate where the photosensitive film is attached so that the single common liquid chamber plate covers the plurality of head units.

Preferably, the method of manufacturing a liquid ejection head further comprises the step of forming at least one alignment mark in the photosensitive film by means of photolithography, wherein the at least one alignment mark is used for aligning the positions of the through holes of the photosensitive film and the positions of the liquid supply ports of the plurality of head units.

Preferably, the through holes and the at least one alignment mark are formed in the photosensitive film simultaneously.

Preferably, a plurality of the alignment marks are formed in the photosensitive film.

In order to attain the aforementioned object, the present invention is also directed to an image forming apparatus comprising one of the liquid ejection heads as defined above, wherein the liquid ejection head ejects the liquid containing coloring material onto a recording medium to form an image on the recording medium.

According to the present invention, it is possible readily to provide a full line liquid ejection head which has good ejection characteristics, at low cost.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
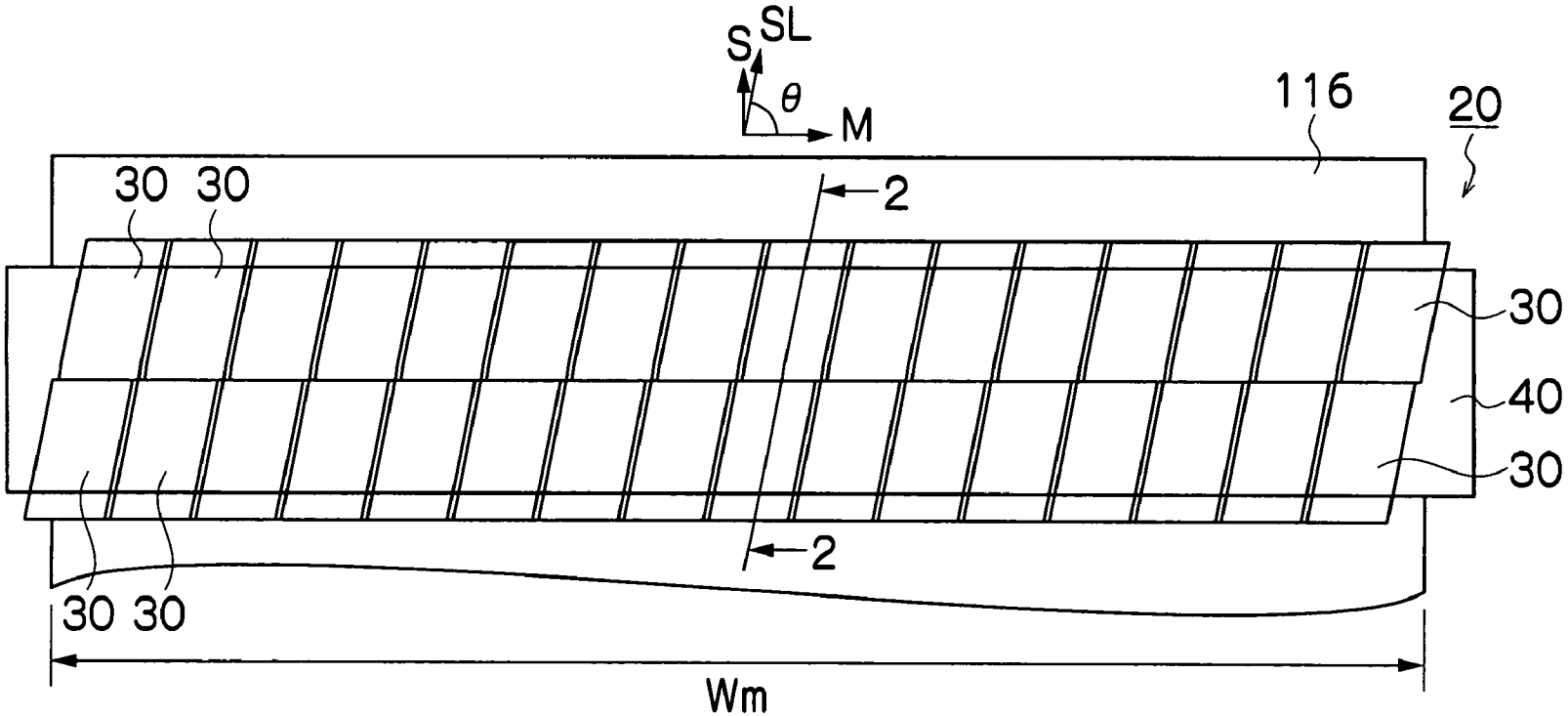
FIG. 1 is a plan view perspective diagram showing the principal part of one example of a liquid ejection head.

FIG. 1 is a plan view perspective diagram showing the principle part of one example of a liquid ejection head relating to an embodiment of the present invention. Furthermore, FIG. 2 shows a cross-sectional diagram along the line 2-2 in FIG. 1.

Figure 2:
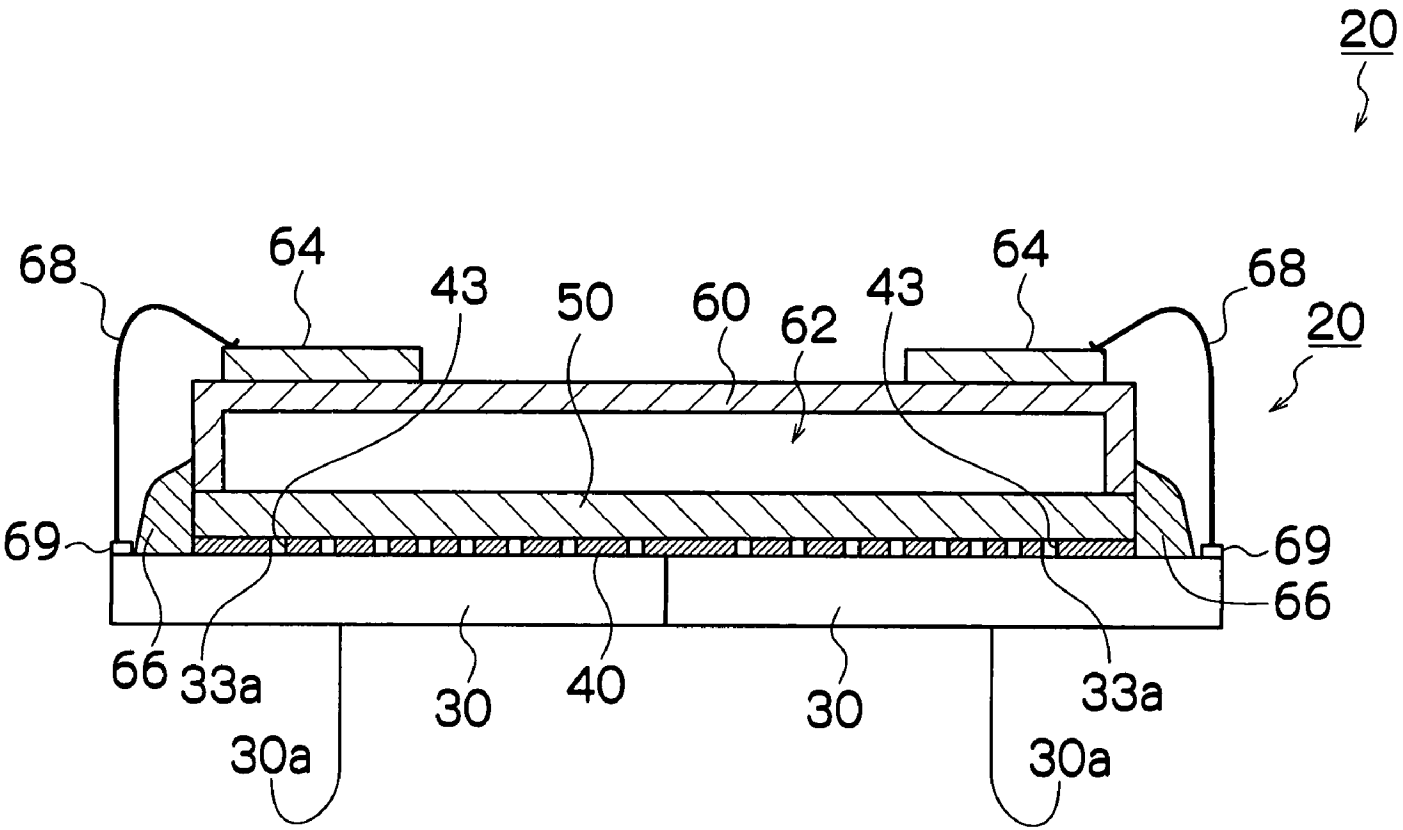
FIG. 2 is a cross-sectional diagram along the line 2-2 in FIG. 1.

In FIG. 1 and FIG. 2, the liquid ejection head 20 is composed by arranging a plurality of head units 30 which eject liquid, in a planar configuration, and covering this plurality of head units 30 with a single common liquid chamber plate 60 which is disposed via a single photosensitive film 40 and a single porous substrate 50. In FIG. 1, in order to simplify the drawing, only the head unit 30 and the photosensitive film 40 are depicted, while the porous substrate 50 and the common liquid chamber plate 60 are omitted from the drawing.

As shown in FIG. 1, the liquid ejection head 20 according to the present embodiment is a so-called full line head, having a structure in which head units 30 which eject liquid toward an ejection receiving medium 116 are arranged through a length corresponding to the width Wm of the ejection receiving medium 116 in the direction perpendicular to the direction of conveyance of the ejection receiving medium 116 (the sub-scanning direction indicated by arrow S in FIG. 1), in other words, in the main scanning direction indicated by arrow M in FIG. 1. In other words, the head units are arranged through a length corresponding to the full width of the ejection receiving region.

FIG. 1 depicts an example of a case where the head units 30 are disposed in a two-dimensional configuration, being arranged in plural fashion (of 16 units) following the main scanning direction M and being arranged in plural fashion (of 2 units) following an oblique direction SL which forms a prescribed acute angle θ (where $0° < \theta < 90°$) with respect to the main scanning direction, but the present invention is not limited in particular to a case of this kind. It is also possible to adopt a one-dimensional configuration in which head units 30 are arranged in plural fashion following the main scanning direction M and are arranged in single fashion following the oblique direction SL.

A single common liquid chamber 62 which is common to all of the head units 30 is formed in the common liquid chamber plate 60. More specifically, as shown in FIG. 2, the common liquid chamber plate 60 has a recessed shaped which is open toward the head units 30, and the upper plate and the side plates of the common liquid chamber 62 are constituted by this common liquid chamber plate 60 while the bottom plate of the common liquid chamber 62 is constituted by the porous substrate 50. The common liquid chamber 62 is provided commonly for all of the head units 30, and supplies liquid to all of the pressure chambers 32 of all of the head units 30.

The porous substrate 50 disposed beneath the common liquid chamber plate 60 has countless very small holes disposed in random positions, and it has permeable properties whereby the ejection liquid can pass through the porous substrate 50 in the thickness direction at the least.

A photosensitive film 40 made of a material which is photosensitive and which has non-permeable properties whereby the ejection liquid cannot pass through the photosensitive film 40 is attached to the lower surface of the porous substrate 50. Through holes 43 are formed by photolithography in this photosensitive film 40, in an arrangement pattern which corresponds to the arrangement pattern of the liquid supply ports 33*a* of the head units 30. The plurality of head units 30 are bonded to the surface of the porous substrate 50 where the photosensitive film is attached.

Figure 3:
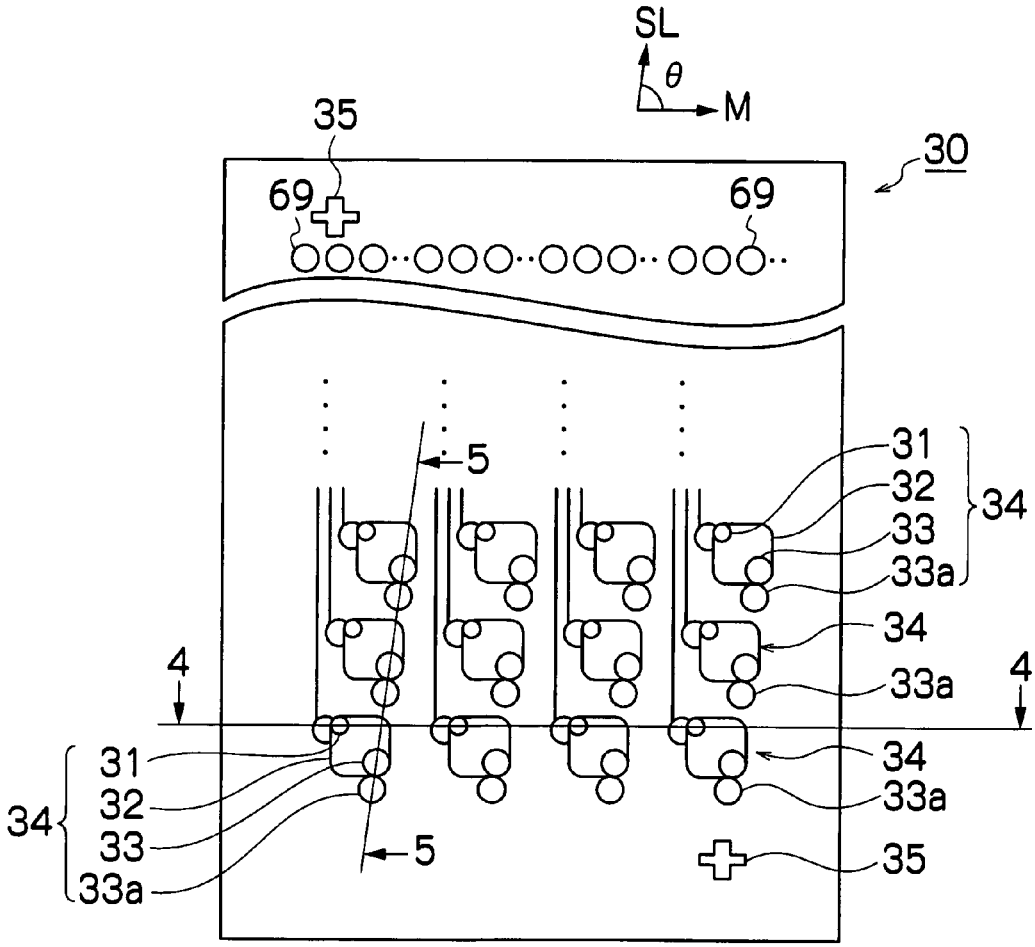
FIG. 3 is a plan view perspective diagram of one example of a head unit.

FIG. 3 shows a plan view perspective diagram of one head unit 30. Furthermore, FIG. 4 shows a cross-sectional view along the line 4-4 in FIG. 3; and FIG. 5 shows a cross-sectional view along the line 5-5 in FIG. 3.

As shown in FIG. 3, the head units 30 each comprise a plurality of pressure chamber units 34 arranged in two directions, namely, in the main scanning direction M and the oblique direction SL. Each of the pressure chamber units 34 comprises: a nozzle 31 which ejects liquid; a pressure chamber 32 connected to the nozzle 31; and liquid supply ports 33 and 33*a* for supplying the liquid to the pressure chamber 32. In FIG. 3, in order to simplify the drawing, only a portion of the pressure chamber units 34 is depicted in the drawing.

Figure 4:
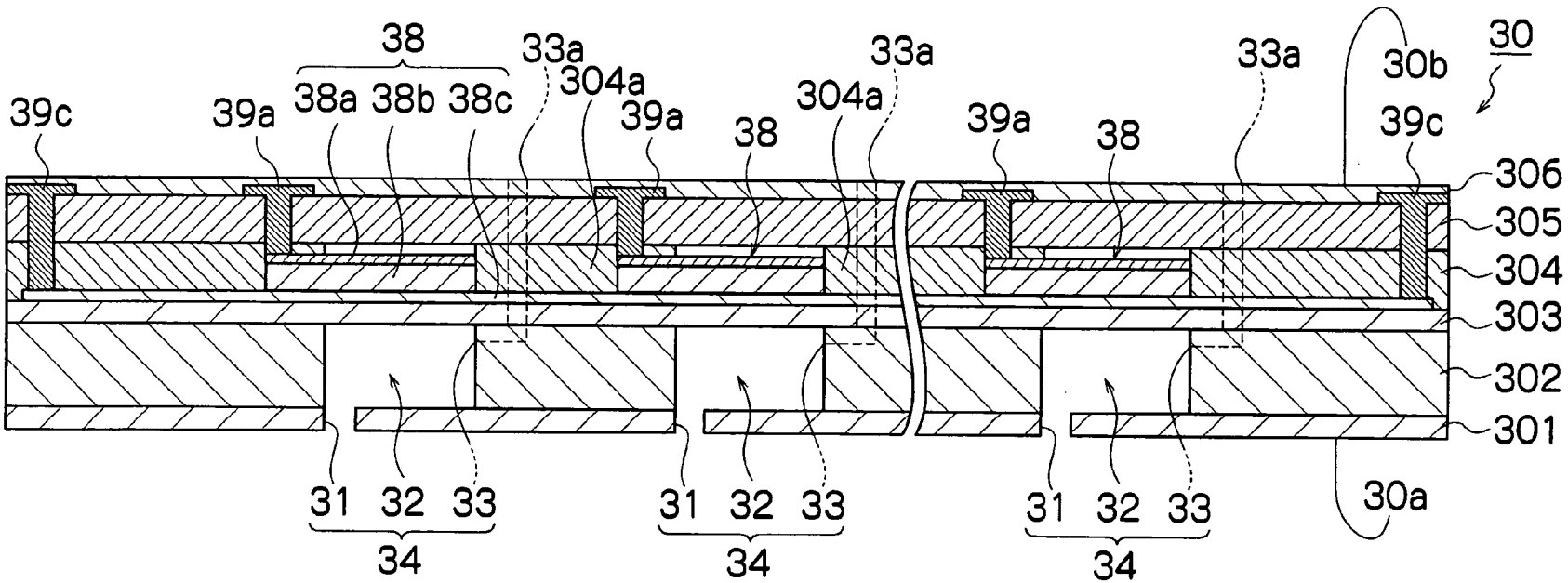
FIG. 4 is a cross-sectional diagram along the line 4-4 in FIG. 3.
Figure 5:
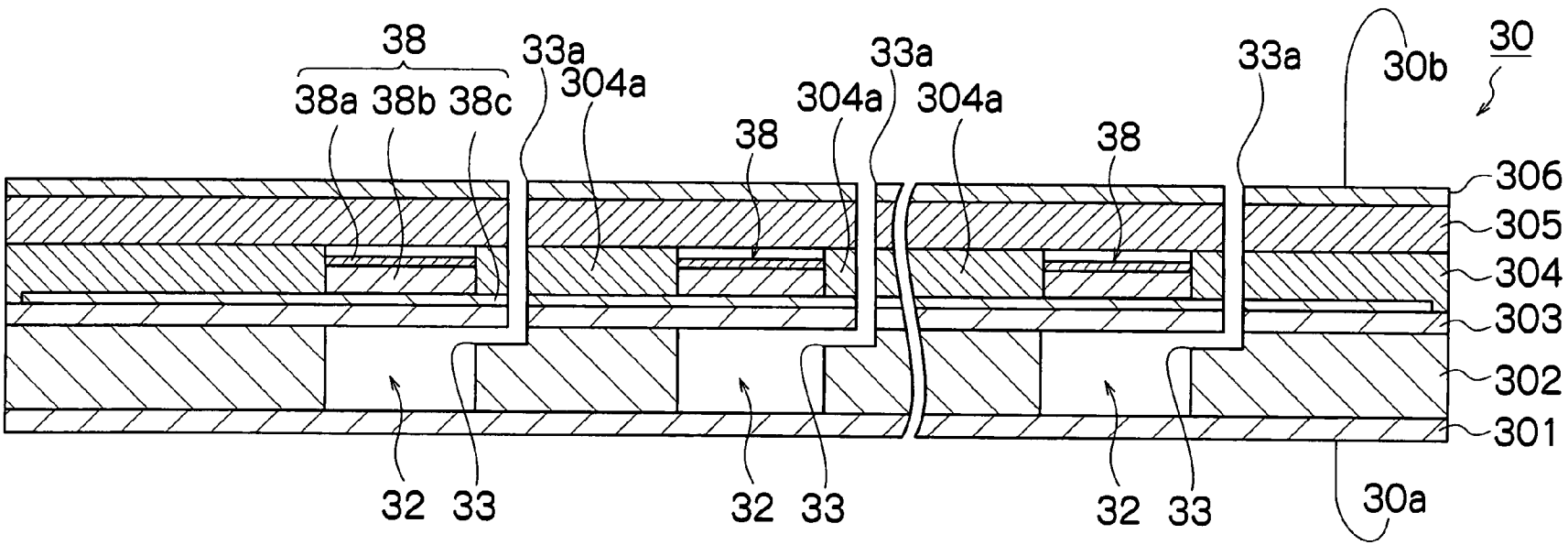
FIG. 5 is a cross-sectional diagram along the line 5-5 in FIG. 3.

Furthermore, each of the head units 30 has a laminated structure, and as shown in FIG. 4 and FIG. 5, each head unit 30 is constituted by: a nozzle plate 301 in which a plurality of nozzles 31 are formed; a pressure chamber plate 302 which is disposed on top of the nozzle plate 301 and in which a plurality of pressure chambers 32 connected respectively to the plurality of nozzles 31 are formed; a diaphragm 303 which is disposed on top of the pressure chamber plate 302 and constitutes the upper surface plate of the pressure chambers 32 and on which a plurality of piezoelectric elements 38 (actuators) are disposed; a partition layer 304 which is disposed on top of the diaphragm 303 and which constitutes partitions 304*a* surrounding the piezoelectric elements 38 on the diaphragm 303; a ceiling plate 305 disposed on top of the partition layer 304; and a protective film 306 disposed on top of the ceiling plate 305.

Each of the piezoelectric elements 38 disposed on top of the diaphragm 303 is constituted by an upper electrode 38*a* made of a conductive material, an active part 38*b* made of a piezoelectric material such as PZT (lead zirconate titanate), and a lower electrode 38*c* made of a conductive material.

The piezoelectric elements 38 correspond to the pressure chambers 32 in a one-to-one relationship, and when a prescribed drive voltage is applied between a pair of the upper electrode 38*a* and the lower electrode 38*c*, the pressure inside the pressure chamber 32 corresponding to the driven piezoelectric element 38 changes, and thereby liquid is ejected from the nozzle 31 connected to that pressure chamber 32.

The upper electrodes 38*a* of the respective piezoelectric elements 38 are provided as individual electrodes which are provided separately with respect to each piezoelectric element 38, whereas the lower electrode 38*c* of the piezoelectric elements 38 is a common electrode which is common to all of the plurality of piezoelectric elements 38.

Upper electrode connection wires 39*a* (drive wires) connected to the upper electrodes 38*a* of the piezoelectric elements 38 are formed on top of the ceiling plate 305. In this way, the head unit 20 has a so-called ceiling plate wiring structure in which the upper electrode connection wires 39*a* leading to the upper electrodes 38*a* of the piezoelectric elements 38 are formed with the ceiling plate 305. The upper electrode connection wires 39*a* are disposed following the oblique direction SL shown in FIG. 1 and FIG. 3.

In the present embodiment, the lower electrode connection wires 39*c* connected to the lower electrode 38*c* of the piezoelectric elements 38 are formed on the ceiling plate 305, but the present invention is not limited in particular to a case such as this and it is also possible for the lower electrode 38*c* of the piezoelectric elements 38 to be formed directly as a common wire, for example.

The drive wires 39*a* on the ceiling plate 305 are connected to the ceiling plate electrodes 69 in FIG. 2, in an end portion of the ceiling plate 305 in the oblique direction SL (in other words, in an end portion of the head unit 30 in the oblique direction SL), and are further connected to a selector circuit 64 shown in FIG. 2, via the wiring members 68 shown in FIG. 2. The selector circuit 64 in FIG. 2 is disposed on the upper surface of the common liquid chamber plate 60 (in other words, on the surface of the common liquid chamber plate 60 opposite to the open side). This selector circuit 64 selects the piezoelectric elements 38 to be driven, of the plurality of piezoelectric elements (38 in FIG. 4) of the plurality of head units 30.

As shown in FIG. 4, the protective film 306 made of resin, or the like, is formed on top of the ceiling plate 305 of the head unit 30 where the drive wires 39*a* and 39*c* are formed, in such a manner that the upper face 30*b* of the head unit 30 has a flat shape. Furthermore, liquid supply ports 33*a* which connect with the pressure chambers 32 are formed in the upper face 30*b* of the head unit 30. In other words, the liquid supply ports 33 which are open to the pressure chambers 32 are extended in the form of flow channels until reaching the upper face 30*b* of the head unit 30, which is the surface that is bonded to the photosensitive film 40, and moreover, they are connected to the through holes 43 in the photosensitive film 40 shown in FIG. 2.

Figure 6:
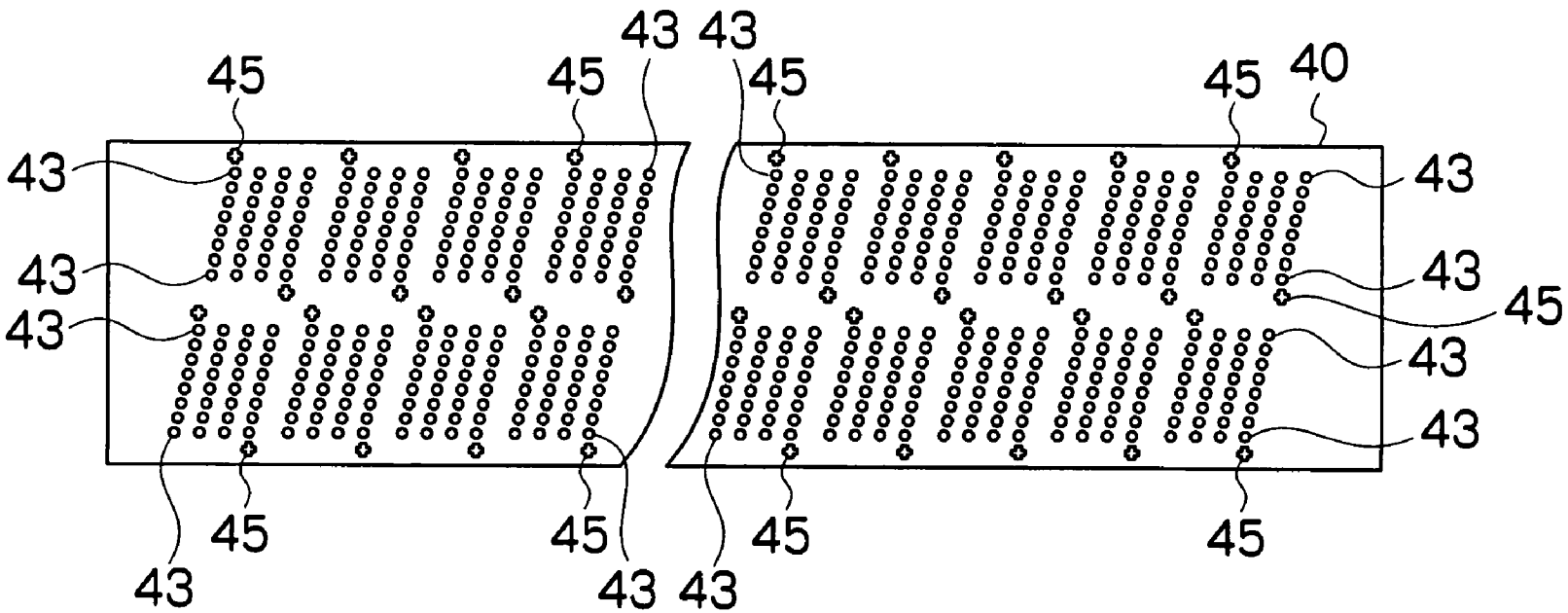
FIG. 6 is a plan diagram of one example of a photosensitive film.

FIG. 6 shows a plan diagram of one example of the photosensitive film 40.

The through holes 43 in the photosensitive film 40 correspond to the liquid supply ports 33*a* which are opened on the upper face 30*b* of the head unit 30 shown in FIG. 5.

Moreover, cross-shaped alignment marks 45 for positioning the through holes 43 of the photosensitive film 40 with respect to the liquid supply ports 33*a* on the upper face of the head unit 30 are formed in the photosensitive film 40. The shape of the alignment marks 45 is not limited in particular to a cross shape, and they may adopt any shape which can be distinguished from the through holes 43 by image recognition. As shown in FIG. 3, cross-shaped alignment marks 35 which can be distinguished from the liquid supply ports 33*a* by image recognition are formed in the head unit 30.

The liquid in the common liquid chamber 62 shown in FIG. 2 passes through the porous substrate 50, which has permeable properties, and along the through holes 43 in the photosensitive film 40 made of non-permeable material, enters into the liquid supply ports 33*a* in the upper faces 30*b* of the respective head units 30, and is supplied to the pressure chambers 32 in the head units 30.

In the head unit 30 shown in FIG. 4, for example, the thickness of the nozzle plate 301 is 30 μm, the thickness of the pressure chamber plate 302 is 150 μm, the thickness of the diaphragm 303 is 20 μm, the thickness of the partition layer 304 is 50 μm, the thickness of the ceiling plate 305 is 200 μm, and the thickness of the protective film 306 is 50 μm. Furthermore, the thickness of the photosensitive film 40 in FIG. 2 is, for example, 50 to 100 μm, the thickness of the porous substrate 50 is 500 μm and the height of the common liquid chamber 62 is 3000 to 5000 μm.

Figure 7:
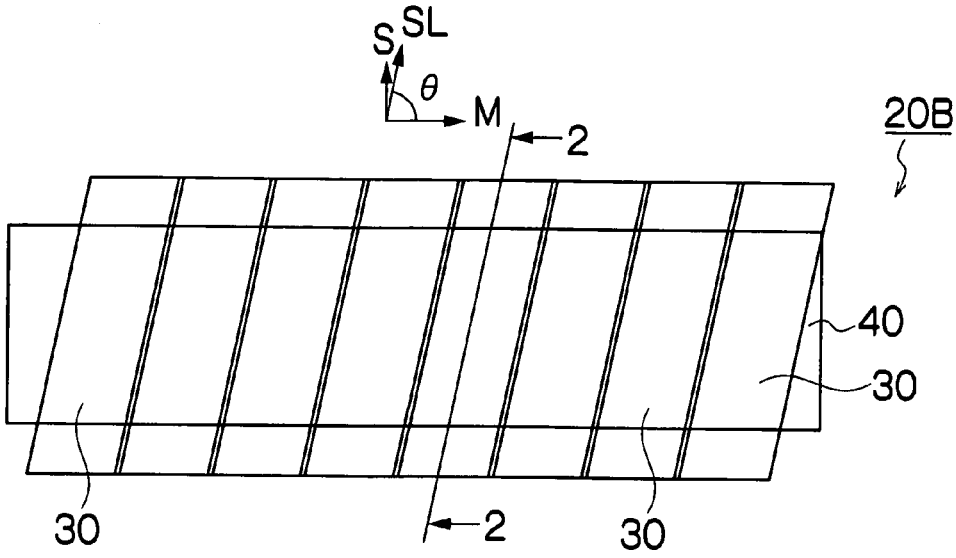
FIG. 7 is a plan view perspective diagram showing a further example of the liquid ejection head.

FIG. 7 is a plan view perspective diagram showing the principal part of a liquid ejection head 20B according to a further embodiment. The liquid ejection head 20B according to the present embodiment has head units 30 disposed in a one-dimensional configuration, being arranged in plural fashion (of 8 units) following the main scanning direction M and in single fashion following the oblique direction SL. FIG. 2 shows a cross-sectional diagram along the line 2-2 in FIG. 7; the respective compositions of the head unit 30 (shown in FIG. 3, FIG. 4 and FIG. 5), the photosensitive film 40 (shown in FIG. 6), the porous substrate 50 and the common liquid chamber plate 60 (shown in FIG. 2) are the same as those of the liquid ejection head 20 shown in FIG. 1, and since these have already been described, further explanation thereof is omitted here.

Below, one example of a manufacturing process of a liquid ejection head is described with reference to FIGS. 8A to 8E and FIGS. 9A to 9E. FIGS. 8A to 8E are plan diagrams and FIGS. 9A to 9E are cross-sectional diagrams along the lines 9A-9A, 9B-9B, 9C-9C, 9D-9D and 9E-9E in FIGS. 8A to 8E.

Figure 8A:
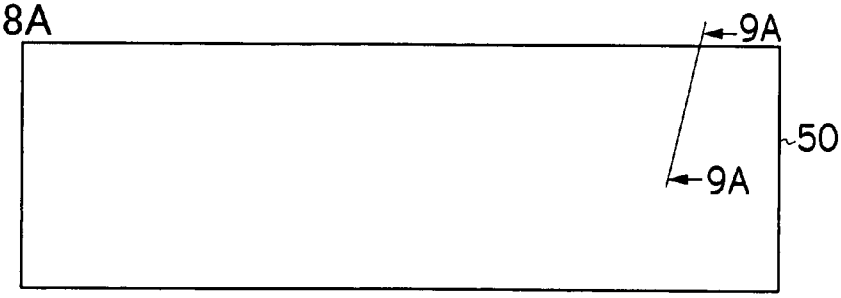
FIGS. 8A to 8E are plan diagrams used for describing a manufacturing process of a liquid ejection head.
Figure 9A:
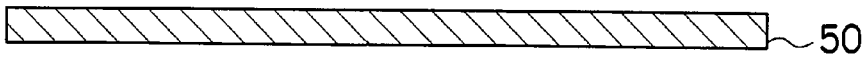
FIGS. 9A to 9E are cross-sectional diagrams used for describing the manufacturing process of the liquid ejection head.

Firstly, as shown in FIG. 8A and FIG. 9A, a single porous substrate 50 having permeable properties is prepared. The material used for the porous substrate 50 is the same material as the main component of the head unit 30 in FIG. 4 which is subsequently to be bonded to same via the photosensitive film 40 in FIG. 6 (and more specifically, the material of the pressure chamber plate 302 which is the thickest part of the head unit 30), or a material having a coefficient of linear expansion which is proximate to (e.g., between 0.5 times and 2 times) that of the main component of the head unit 30 (and more specifically, the pressure chamber plate 302). For example, if the main component of the head unit 30 is silicon, then possible materials for the porous substrate 50 are porous ceramic, porous silicon, and the like. By ensuring a small differential between the coefficient of linear expansion of the porous substrate 50 and that of the head unit 30 in this way, it is possible to ensure that the warping of the liquid ejection head 20 is sufficiently small to be negligible, even when manufacturing a liquid ejection head 20 having a long dimension.

The thickness and the porosity rate of the porous substrate 50 are calculated on the basis of the required rigidity and flow channel resistance. In other words, the thickness is required which corresponds to the prescribed rigidity needed in order sufficiently to minimize warping of the liquid ejection head 20 being manufactured, while at the same time, the porosity rate is required which ensures that the flow channel resistance is lower than a prescribed value, at the established thickness.

Furthermore, in order to increase liquid resistance properties, a resin coating of polyimide, or the like, can be provided on the whole of the porous substrate 50. If the pores inside the porous substrate 50 are also coated with resin, then the resin coating is carried out in such a manner that the pores are not sealed completely by the resin.

Figure 8B:
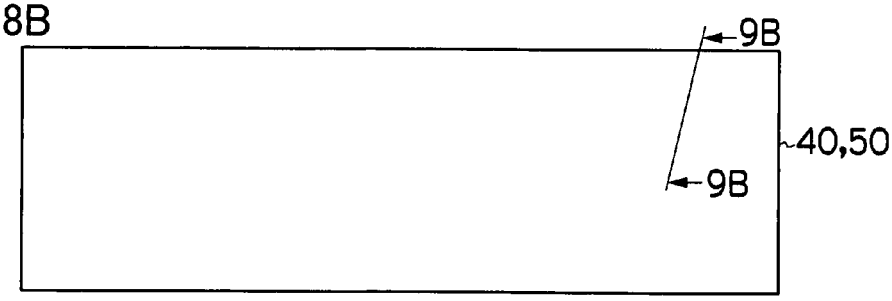
Figure 9B:
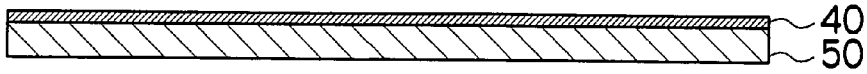

Next, as shown in FIG. 8B and FIG. 9B, a single photosensitive film 40 is attached to one surface of the porous substrate 50. Here, for the material of the photosensitive film 40, a dry film which has photosensitivity and non-permeable properties is used. In other words, by attaching the single photosensitive film 40 to one surface of the porous substrate 50, a laminating operation is carried out to form a thin layer having photosensitive and non-permeable properties on one surface of the permeable porous substrate 50.

This laminating operation is carried out by thermal pressure deposition (heating and pressurization by a roller: thermo-compression bonding).

For the material of the photosensitive film 40, for example, a dry film having liquid resistant properties, such as an epoxy resin, a polyimide resin, or the like can be used. The photosensitive film 40 makes contact with the liquid passing through the porous substrate 50, and therefore the material is selected so as not to cause peeling due to the photosensitive film 40 being attacked by the components of the liquid.

By attaching the photosensitive film 40 having non-permeable and liquid resistant properties, as well as photosensitive properties, to the permeable porous substrate 50, it is possible to seal the head units 30 sufficiently, and also to prevent the infiltration of adhesive into the porous substrate 50.

Figure 8C:
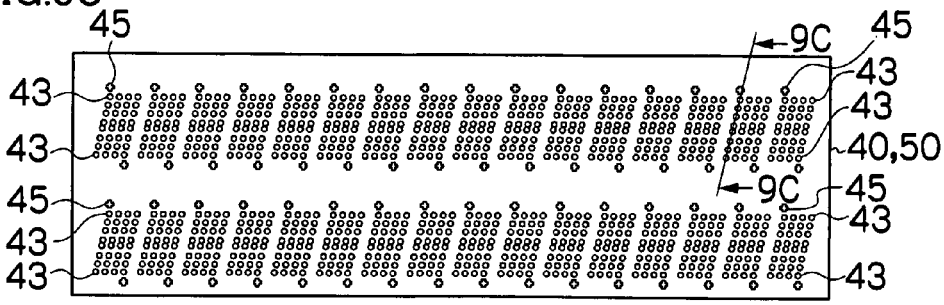
Figure 9C:
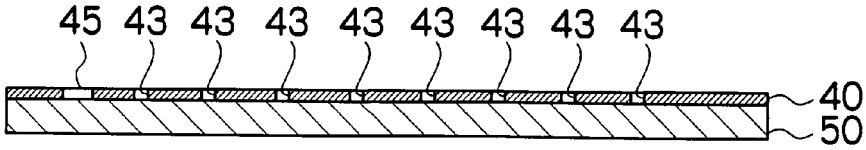

Next, as shown in FIG. 8C and FIG. 9C, through holes 43 and cross-shaped alignment marks 45 are formed by photolithography in the photosensitive film 40.

The arrangement pattern of the through holes 43 in the photosensitive film 40 corresponds to the arrangement pattern of the liquid supply ports 33*a* in the upper face 30*b* of the head unit 30 shown in FIG. 3. The arrangement pattern of the through holes 45 in the photosensitive film 40 corresponds to the arrangement pattern of the alignment marks 35 in the upper face 30*b* of the head unit 30 shown in FIG. 3.

Figure 8D:
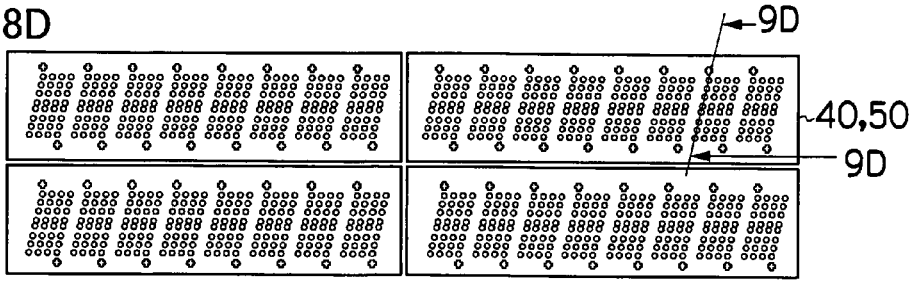
Figure 9D:
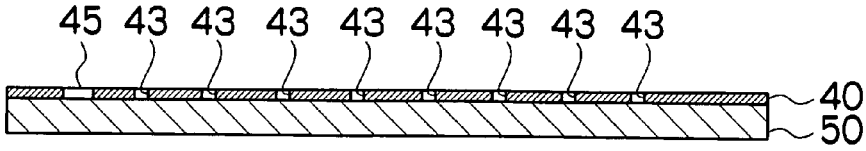

Thereupon, according to requirements, the porous substrate 50 together with the photosensitive film 40 is cut, by means of dicing, into pieces having a size corresponding to the bar-shaped liquid ejection head 20 that is to be manufactured, as shown in FIG. 8D and FIG. 9D. FIG. 8D and FIG. 9D show dicing in the case of manufacturing a liquid ejection head 20B having a one-dimensional arrangement, as shown in FIG. 7, but there may also be cases where dicing is not necessary.

Figure 8E:
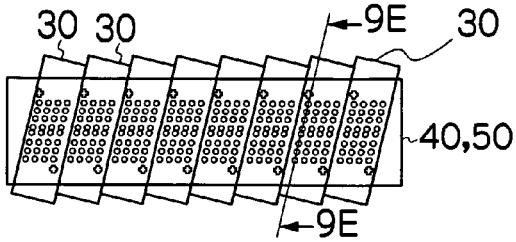
Figure 9E:
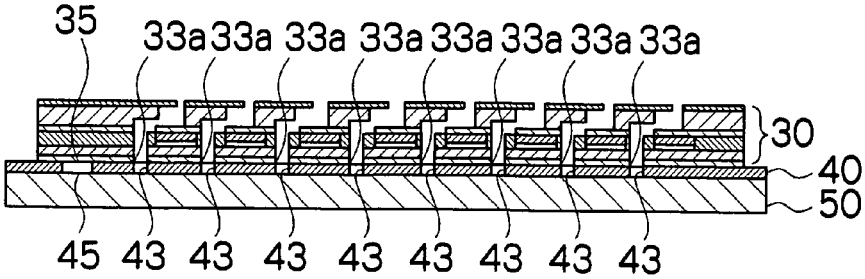

Next, as shown in FIG. 8E and FIG. 9E, a plurality of head units 30 are bonded by adhesive onto the surface of the porous substrate 50 where the photosensitive film 40 is attached (the laminated surface), this plurality of head units 30 being arranged in a planar configuration. In this, alignment between the through holes 43 in the photosensitive film 40 and the liquid supply ports 33*a* in the upper face 30*b* of the head units 30 is carried out before being bonded together.

Figure 10:
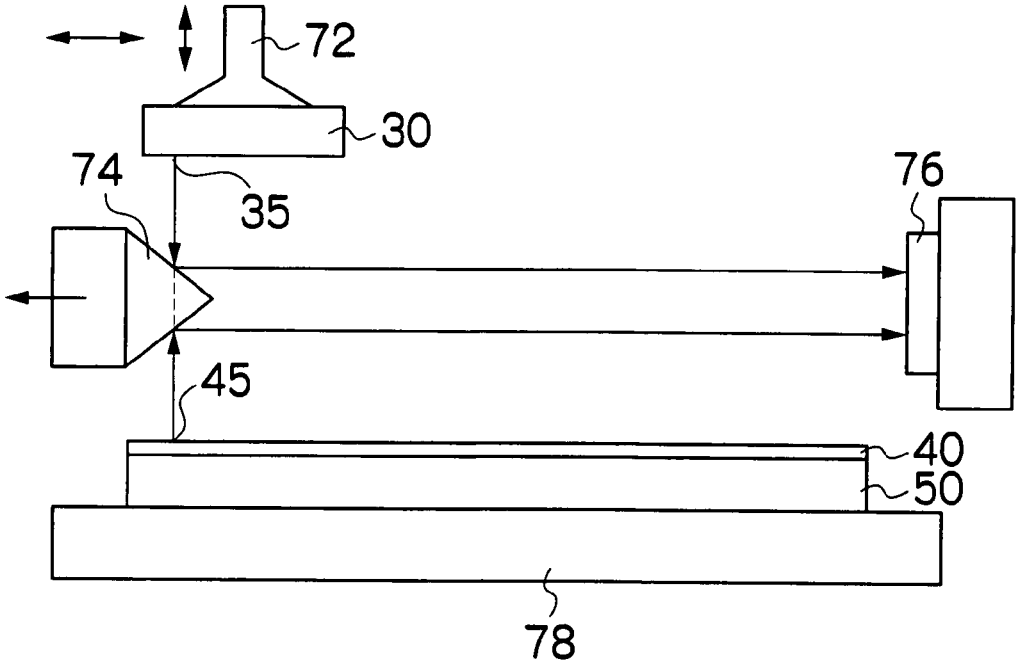
FIG. 10 is an illustrative diagram for describing the arrangement of head units carried out by using alignment marks in the photosensitive film.

More specifically, as shown in FIG. 10, images of the cross-shaped alignment marks 45 formed in the photosensitive film 40 on the porous substrate 50 and the cross-shaped alignment marks formed in the head unit 30 suctioned by a suction arm 72 are captured by means of an image sensor 76, such as a CCD (Charge Coupled Device), after being reflected by a half mirror 74, and by performing image recognition, the suction arm 72 (or a table 78 on which the porous substrate 50 is mounted) is moved in the horizontal direction in such a manner that both alignment marks 45 and 35 are positioned on the same vertical axis. When both alignment marks 45 and 35 have been positioned on the same vertical axis, the half mirror 74 is withdrawn in the horizontal direction, and the suction arm 72 is moved vertically toward the porous substrate 50. By this means, two alignment marks 45 and 35 are aligned in position when the head unit 30 is bonded to the porous substrate 50 via the photosensitive film 40. Thereby, it is possible to achieve highly accurate alignment and bonding.

As shown in FIG. 2, a common liquid chamber plate 60 formed with the common liquid chamber 62 is then bonded to the surface of the porous substrate 50 on the side opposite to the surface where the photosensitive film 40 is bonded (the laminated surface), in such a manner that the recess section forming the common liquid chamber 62 is orientated toward the porous substrate 50. In other words, the end of the recess-shaped common liquid chamber plate 60 is bonded to the end of the flat plate-shaped porous substrate 50. Here, the end of the porous substrate 50 is sealed with a sealant 66. Furthermore, the electrodes 69 of the head unit 30 are connected by wiring members 68 to the electrodes of the selector circuit 64 which is formed on the upper face of the common liquid chamber plate 60.

In the liquid ejection head 20 according to the present embodiment, the common liquid chamber 62 in FIG. 2 is disposed to the exterior of the head units 30, rather than being disposed inside the head units 30, and furthermore, the common liquid chamber 62 is formed as a chamber of large capacity which is common to all of the head units 30 arranged in a planar configuration, rather than being formed separately for each individual head unit 30. In other words, a plurality of head units 30 are arranged in a planar configuration, and this plurality of head units 30 are covered with the single common liquid chamber plate 60, thereby providing the single large-capacity common liquid chamber 62 for the plurality of head units 30. By this means, liquid is supplied directly from the single large-capacity common liquid chamber 62 to the pressure chambers (32 in FIG. 3) of all of the head units 30 which are positioned directly below the common liquid chamber 62, and therefore the pressure waves are not liable to propagate between the pressure chambers 32 through the common liquid chamber 62, thus making it possible to suppress fluid cross-talk between the pressure chambers 32, as well as being able to suppress variation in ejection characteristics between the head units 30. Moreover, since a rear surface flow channel structure is adopted in which liquid is supplied directly from the common liquid chamber 62 to the head units 30 positioned directly below same, then there is little stagnation of the flow of liquid, gas bubbles are not liable to stay and collect, and furthermore, the flow channels are shortened, which means that liquid can be supplied with little pressure loss and refilling of liquid is also speeded up.

Consequently, there is little variation in ejection characteristics between the head units 30, and it is possible to provide a full line liquid ejection head which has good ejection characteristics.

In such a liquid ejection head 20 having a rear surface flow channel structure comprising the common liquid chamber 62 which is common to all of the head units 30 in this fashion, the porous substrate having permeable properties is disposed below the common liquid chamber plate 60, the photosensitive film 40 which is made of a photosensitive and non-permeable material and contains the through holes 43 formed by photolithography so as to correspond to liquid supply ports 33*a* in the upper faces 30*a* of the head units 30, is attached to the lower face of the porous substrate 50, and a plurality of head units 30 are bonded onto the photosensitive film 40. In other words, a structure is adopted in which the porous substrate 50 having a laminated surface with the photosensitive film 40 is disposed between the common liquid chamber 62 and the plurality of head units 30 arranged in a planar configuration. By this means, it is possible to filter foreign matter in the liquid and to trap gas bubbles in the liquid, by means of the porous substrate 50, and also to prevent leaking of liquid from between the head units 30, by creating a reliable seal between the head units 30 by means of the photosensitive film 40. The porous substrate 50 contains countless pores, and the flow channel resistance of the porous substrate 50 can be reduced while ensuring sufficient rigidity in order to serve as a substrate to which the plurality of head units 30 are bonded. Furthermore, since the through holes 43 and the alignment marks 45 can be formed simultaneously in the photosensitive film 40 having photosensitive properties, as shown in FIG. 6, then it is possible to locate the head units 30 in position easily, with good accuracy. Since high-accuracy positioning of the head units 30 can be achieved readily in this way, then it is possible to reduce the size of each head unit 30 and to arrange a large number of head units 30, thus increasing the number of head units 30 which can be taken from a base material wafer, ensuring efficient and waste-free use of the base material, and enabling a full line liquid ejection head 20 to be manufactured readily at low cost.

Furthermore, by adopting a structure in which a plurality of head units 30 are bonded to a single common liquid chamber plate 60 having a recess section constituting a common liquid chamber 62, via a single porous substrate 50 and a single photosensitive film 40, and by adopting a structure in which the common liquid chamber plate 60 is used as a substrate for a selector circuit 64, then the number of members required in the manufacture of the full line liquid ejection head 20 is reduced markedly, and this has the beneficial effects of reducing costs.

Figure 11:
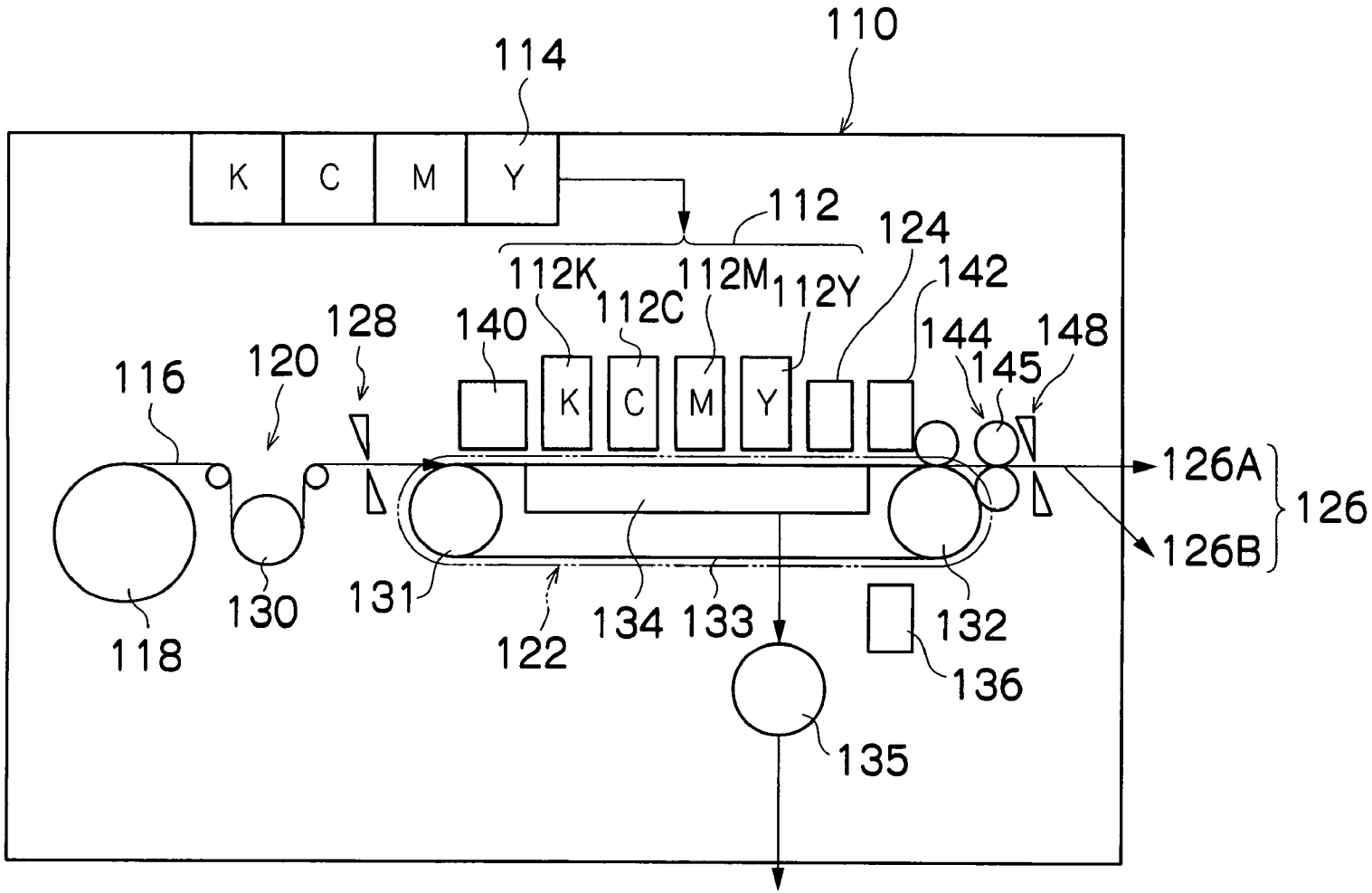
FIG. 11 is a general schematic drawing showing one example of an image forming apparatus.

FIG. 11 is a general schematic drawing of one example of an image forming apparatus 110 comprising a liquid ejection head according to an embodiment of the present invention.

As shown in FIG. 11, the image forming apparatus 110 comprises: a liquid ejection unit 112 having a plurality of liquid ejection heads 112K, 112C, 112M, and 112Y for respective ink colors; an ink storing and loading unit 114 for storing inks to be supplied to the liquid ejection heads 112K, 112C, 112M, and 112Y; a paper supply unit 118 for supplying an ejection receiving medium 116, such as paper; a decurling unit 120 for removing curl in the ejection receiving medium 116; a belt conveyance unit 122 disposed facing the nozzle face of the liquid ejection unit 112, for conveying the ejection receiving medium 116 while keeping the ejection receiving medium 116 flat; an ejection determination unit 124 for reading the ejection result (liquid droplet landing state) produced by the liquid ejection unit 112; and a paper output unit 126 for outputting printed ejection receiving medium to the exterior.

By using a liquid ejection head 20 as shown in FIG. 1 and FIG. 2 for the liquid ejection heads 112K, 112C, 112M, and 112Y in FIG. 11, and by ejecting liquid (ink) containing a colorant (also called "coloring material") onto the ejection receiving medium 116 from the liquid ejection heads 112K, 112C, 112M, and 112Y, an image is formed on the ejection receiving medium 116.

In FIG. 11, a supply of rolled paper (continuous paper) is displayed as one example of the paper supply unit 118, but it is also possible to use a supply unit which supplies cut paper that has been cut previously into sheets. In a case where rolled paper is used, a cutter 128 is provided. Therefore, the ejection receiving medium 116 delivered from the paper supply unit 118 generally retains curl. In order to remove this curl, heat is applied to the ejection receiving medium 116 in the decurling unit 120 by a heating drum 130 in the direction opposite to the direction of the curl. After decurling, the cut ejection receiving medium 116 is delivered to the belt conveyance unit 122.

The suction belt conveyance unit 122 has a configuration in which an endless belt 133 is set around rollers 131 and 132 so that the portion of the endless belt 133 facing at least the nozzle face of the liquid ejection unit 112 and the sensor face of the ejection determination unit 124 forms a horizontal plane (flat plane). The belt 133 has a width that is greater than the width of the ejection receiving medium 116, and a plurality of suction apertures (not shown) are formed on the belt surface. A suction chamber 134 is disposed in a position facing the sensor surface of the ejection determination unit 124 and the nozzle surface of the liquid ejection unit 112 on the interior side of the belt 133, which is set around the rollers 131 and 132, as shown in FIG. 11; and this suction chamber 134 provides suction with a fan 135 to generate a negative pressure, thereby holding the ejection receiving medium 116 onto the belt by suction. The belt 133 is driven in the clockwise direction in FIG. 11 by the motive force of a motor (not illustrated) being transmitted to at least one of the rollers 131 and 132, which the belt 133 is set around, and the ejection receiving medium 116 held on the belt 133 is conveyed from left to right in FIG. 11. Since ink adheres to the belt 133 when a marginless print or the like is formed, a belt cleaning unit 136 is disposed in a predetermined position (a suitable position outside the print region) on the exterior side of the belt 133. A heating fan 140 is provided on the upstream side of the liquid ejection unit 112 in the paper conveyance path formed by the belt conveyance unit 122. This heating fan 140 blows heated air onto the ejection receiving medium 116 before printing, and thereby heats up the ejection receiving medium 116. Heating the ejection receiving medium 116 immediately before printing has the effect of making the ink dry more readily after landing on the paper.

Figure 12:
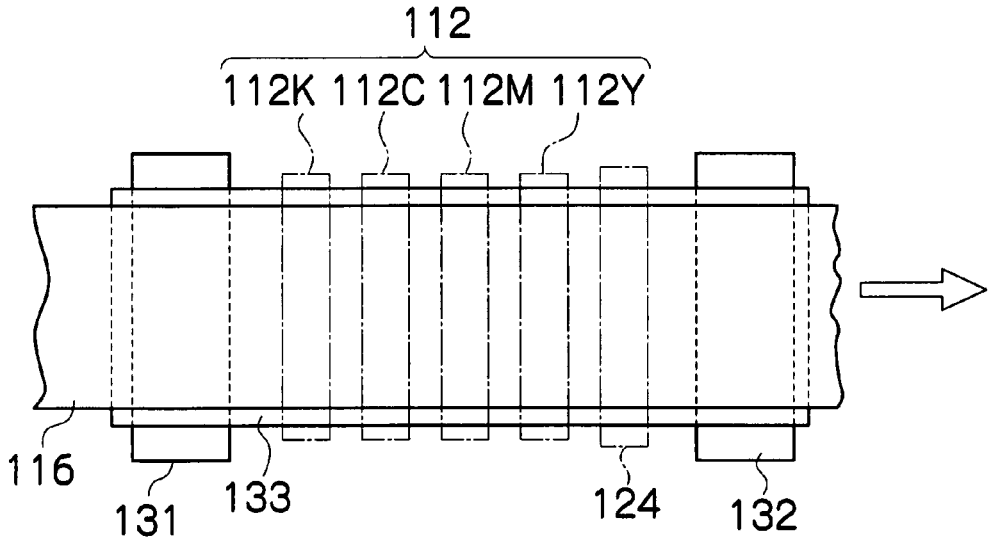
FIG. 12 is a plan diagram showing the ejection unit of the image forming apparatus and the peripheral region of same.

FIG. 12 is a principal plan diagram showing the liquid ejection unit 112 of the image forming apparatus 110, and the peripheral region thereof.

As shown in FIG. 12, the liquid ejection unit 112 includes so-called "full line heads" in which each of line heads having a length corresponding to the maximum paper width is arranged in a direction (main scanning direction) that is perpendicular to the medium conveyance direction (sub-scanning direction). More specifically, the respective liquid ejection heads 112K, 112C, 112M, and 112Y are full line heads which each have a plurality of nozzles (liquid ejection ports) arranged through a length exceeding at least one edge of the maximum size of ejection receiving medium 116 intended for use with the image forming apparatus 110.

The liquid ejection heads 112K, 112C, 112M, and 112Y corresponding to respective ink colors are disposed in the order, black (K), cyan (C), magenta (M), and yellow (Y), from the upstream side (left-hand side in FIG. 12), following the direction of conveyance of the ejection receiving medium 116 (the medium conveyance direction). A color image can be formed on the ejection receiving medium 116 by ejecting the inks including coloring material from the print heads 112K, 112C, 112M, and 112Y, respectively, onto the ejection receiving medium 116 while conveying the ejection receiving medium 116.

The liquid ejection unit 112, in which the full-line heads covering the entire width of the paper are thus provided for the respective ink colors, can record an image over the entire surface of the ejection receiving medium 116 by performing the action of moving the ejection receiving medium 116 and the liquid ejection unit 112 relatively to each other in the medium conveyance direction (sub-scanning direction) just once (in other words, by means of a single sub-scan). Higher-speed printing is thereby made possible and productivity can be improved in comparison with a shuttle type head which moves reciprocally in a direction (main scanning direction) which is perpendicular to the medium conveyance direction (sub-scanning direction).

The terms "main scanning direction" and "sub-scanning direction" are used in the following senses. More specifically, in a full-line head comprising rows of nozzles that have a length corresponding to the entire width of the ejection receiving medium, "main scanning" is defined as printing one line (a line formed of a row of dots, or a line formed of a plurality of rows of dots) in the breadthways direction of the ejection receiving medium (the direction perpendicular to the conveyance direction of the ejection receiving medium) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line formed by the main scanning (a line formed of a row of dots, or a line formed of a plurality of rows of dots), while moving the full-line head and the ejection receiving medium relatively with respect to each other. The direction in which sub-scanning is performed is called the sub-scanning direction. Consequently, the conveyance direction of the ejection receiving medium is the sub-scanning direction and the direction perpendicular to same is called the main scanning direction.

Although a configuration with the four standard colors, K, C, M, and Y, is described in the present embodiment, the combinations of the ink colors and the number of colors are not limited to those of the present embodiment, and light and/or dark inks can be added as required. For example, a configuration is possible in which ink ejection heads for ejecting light-colored inks such as light cyan and light magenta are added.

As shown in FIG. 11, the ink storing and loading unit 114 has ink tanks for storing inks of the colors corresponding to the respective liquid ejection heads 112K, 112C, 112M, and 112Y, and the ink tanks are respectively connected to the liquid ejection heads 112K, 112C, 112M, 112Y, via tubing channels (not illustrated).

The ejection determination unit 124 has an image sensor (line sensor and the like) for capturing an image of the ejection result of the liquid ejection unit 112, and functions as a device to check for ejection defects such as clogs of the nozzles from the image evaluated by the image sensor.

A post-drying unit 142 is disposed following the ejection determination unit 124. The post-drying unit 142 is a device to dry the printed image surface, and includes a heating fan, for example. A heating and pressurizing unit 144 is provided at a stage following the post-drying unit 142. The heating and pressurizing unit 144 is a device which serves to control the luster of the image surface, and it applies pressure to the image surface by means of pressure rollers 145 having prescribed surface undulations, while heating same. Accordingly, an undulating form is transferred to the image surface.

The printed object generated in this manner is output via the paper output unit 126. In the image forming apparatus 110, a sorting device (not shown) is provided for switching the outputting pathway in order to sort a printed matter with the target print and a printed matter with the test print, and to send them to output units 126A and 126B, respectively. If the main image and the test print are formed simultaneously in a parallel fashion, on a large piece of printing paper, then the portion corresponding to the test print is cut off by means of the cutter (second cutter) 148. The cutter 148 is disposed just before the paper output section 126, and serves to cut and separate the main image from the test print section, in cases where a test image is printed onto the white margin of the image. Moreover, although omitted from the drawing, a sorter for collecting and stacking the images according to job orders is provided in the paper output section 126A for the main images.

Here, examples are described above in which the actuators of the liquid ejection head 20 are constituted by piezoelectric elements, but the actuators according to the present invention are not limited to being piezoelectric elements. For example, the present invention can also be applied to a case where the actuators are constituted by heating elements (heaters).

The present invention is not limited to the examples described in the present specification or shown in the drawings, and various design modifications and improvements may of course be implemented without departing from the scope of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of head units each of which includes a plurality of nozzles, a plurality of pressure chambers connected respectively to the plurality of nozzles, liquid supply ports for supplying liquid respectively to the plurality of pressure chambers, and a plurality of actuators causing the liquid to be ejected respectively from the plurality of nozzles;

a single common liquid chamber plate formed with a common liquid chamber which supplies the liquid to the plurality of pressure chambers of the plurality of head units;

a porous substrate which has permeable properties and is disposed below the single common liquid chamber plate so as to constitute a lower surface plate of the common liquid chamber; and a photosensitive film which is made of a material having photosensitivity and non-permeable properties, has through holes which correspond to an arrangement pattern of the liquid supply ports of the head units, and is attached to a lower surface of the porous substrate, wherein:

the plurality of head units are arranged in a planar configuration;

the plurality of head units are covered with the single common liquid chamber plate;

the common liquid chamber is provided in common to the plurality of head units; and the plurality of head units are bonded to the porous substrate via the photosensitive film.

2. The liquid ejection head as defined in claim 1, wherein the porous substrate is made of a same material as a main component of the plurality of head units, or a material having a coefficient of linear expansion between 0.5 times and 2 times a coefficient of linear expansion of the main component of the plurality of head units.

3. An image forming apparatus, comprising:

the liquid ejection head as defined in claim 2, wherein the liquid ejection head ejects the liquid containing coloring material onto a recording medium to form an image on the recording medium.

4. An image forming apparatus, comprising:

the liquid ejection head as defined in claim 1, wherein the liquid ejection head ejects the liquid containing coloring material onto a recording medium to form an image on the recording medium.

5. A liquid ejection head, comprising:

a plurality of head units each of which includes a plurality of nozzles, a plurality of pressure chambers connected respectivel to the plurality of nozzles, liquid supply ports for supplying liquid respectively to the plurality of pressure chambers, and a plurality of actuators causing the liquid to be ejected respectively from the plurality of nozzles;

a single common liquid chamber plate formed with a common liquid chamber which supplies the liquid to the plurality of pressure chambers of the plurality of head units; and a selector circuit which selects at least one actuator to be driven, of the plurality of actuators, wherein:

the plurality of head units are arranged in a planar configuration;

the plurality of head units are covered with the single common liquid chamber plate;

the common liquid chamber is provided in common to the plurality of head units;

the single common liquid chamber plate has a recessed shape which is open toward the plurality of head units; and the selector circuit is disposed on a surface of the single common liquid chamber plate on a side opposite to an open side of the single common liquid chamber plate.

6. An image forming apparatus, comprising:

the liquid ejection head as defined in claim 4, wherein the liquid ejection head ejects the liquid containing coloring material onto a recording medium to form an image on the recording medium.

7. A liquid ejection head, comprising:

a plurality of head units each of which includes a plurality of nozzles, a plurality of pressure chambers connected respectivel to the plurality of nozzles liquid supply ports for supplying liquid respectively to the plurality of pressure chambers, and a plurality of actuators causing the liquid to be ejected respectively from the plurality of nozzles;

a single common liquid chamber plate formed with a common liquid chamber which supplies the liquid to the plurality of pressure chambers of the plurality of head units; and drive wires which are formed on an upper surface of the head units and are connected to the actuators, wherein:

the plurality of head units are arranged in a planar configuration;

the plurality of head units are covered with the single common liquid chamber plate; and the common liquid chamber is provided in common to the plurality of head units.

8. An image forming apparatus, comprising:

the liquid ejection head as defined in claim 7, wherein the liquid ejection head ejects the liquid containing coloring material onto a recording medium to form an image on the recording medium.

* * * * *